US005828019A

United States Patent [19]

Joyce

[11] Patent Number: 5,828,019

[45] Date of Patent: Oct. 27, 1998

[54] MOTORIZED SEQUENCING SWITCH ASSEMBLY

[75] Inventor: Ronald S. Joyce, Elk Grove Village, Ill.

[73] Assignee: Eaton Corporation, Cleveland, Ohio

[21] Appl. No.: 651,371

[22] Filed: May 22, 1996

[51] Int. Cl.[6] ..... H01H 43/10

[52] U.S. Cl. ..... 200/38 B; 200/37 A; 200/38 R

[58] Field of Search ..... 200/38 B, 38 BA, 200/11 DA, 36, 37 R, 37 A, 38 R, 153 L

[56] References Cited

U.S. PATENT DOCUMENTS 3,627,937 12/1971 Swanke et al. ..... 200/38 B
3,679,850 7/1972 Arzt et al. ..... 200/37 R
3,819,886 6/1974 Homan et al. ..... 200/38 B
4,097,702 6/1978 Halsted ..... 200/153 LB

*Primary Examiner*—Adolf Berhane
*Attorney, Agent, or Firm*—Roger A. Johnston

[57] ABSTRACT

A rotary cam actuated sequence switch assembly having a reversible electric drive for forward and reverse movement to selectively position the cam for actuating a plurality of switches in a desired sequence under electronic control of the motor. Reverse rotation of the cam causes a flip-over follower to lift the blade contacts of the switch controlling line power to the remaining switches thereby preventing the reverse rotation from causing damage to the device being controlled by the switches.

14 Claims, 4 Drawing Sheets

MOTORIZED SEQUENCING SWITCH ASSEMBLY

BACKGROUND OF THE INVENTION

The present invention relates to devices for sequentially actuating a plurality of switches for providing programmable switching of machine or appliance control functions in a selected program interval. The invention particularly relates to devices of this type having a plurality of stationary switches sequentially actuated by a rotating cam. Programmed or sequenced switching of this type has found application in the control of the program functions of household appliances as, for example, washing machines, clothes dryers and dishwashers.

Heretofore, electromechanical programmer timers have been employed for such appliances wherein a rotary cam is periodically advanced or indexed by a timed advance mechanism for effecting sequential actuation and de-actuation a plurality of machine or appliance function control switches. In such typical known electromechanical programmer timer arrangements, one full revolution of the cam comprises a complete program interval or cycle for the machine or appliance. Thus, the timing accuracy or number of switch actuations and de-actuations controllable in a given program interval is limited by the available circumference of the cam. Where size or volume of the programmer timer is limited, it has been difficult to increase the timing accuracy or number of switch actuations and deactuations in a program cycle or to shorten the time between switch actuation or between sequential switch operation because of the limitations in providing the required cam profile for a given rate of timed cam advancement. Thus, it has been desired to provide an improved or more sophisticated switching control mechanism for such machines or appliances.

With the advent of relatively low cost microprocessors, it has been proposed to replace appliance electromechanical programmer timers utilizing timed advancement of a switch operating cam with a switch sequence controller which utilizes programmable electronics to drive a motorized advance connected to the cam to position the switch cam to a desired position at a desired time rather than to continuously advance or periodically index a program cam through a revolution of rotary movement for the program cycle. However, if the switch operating cam is to be selectively positioned at a given time, it will be necessary to rotate the cam to a predetermined rotary position for a given switch actuation in order to produce the desired actuation of associated switches having cam followers following a cam for effecting switch actuation. This latter arrangement is also known as a hybrid programmer, where electronics are used to control the cam advance motor for intermittent operation to achieve the desired sequence of switch operation instead of progressively advancing a program cam at a timed rate and relying on the program cam profile to achieve the desired sequencing of the function control switches.

A hybrid programmer thus provides the sophistication of electronic program control, yet retains the robustness of mechanically actuated electrical switching contacts which is required for switching relatively high current loads repeatedly over prolonged service. In order to provide the most effective program capability and desired rate of response in a hybrid programmer, it has been found desirable to have the cam drive motor capable of driving the cam in both clockwise and counter-clockwise, or forward and reverse directions. However, if the cam is driven in a reverse direction for positioning, undesired reverse sequence switching of function control switches will result and may damage the appliance.

Thus, it has been desired to provide a rotary sequencing switch for a plurality of appliance function control switches which is simple in construction, easy to manufacture and relatively low in cost and which permits electronically controlled motorized rapid forward or reverse movement of the cam for selective positioning of the cam without unwanted actuation of associated switches.

SUMMARY OF THE INVENTION

It is an object of the present invention to provide a sequencing mechanism for a plurality of switches which are cam actuated by an electronically controlled motor drive to rapidly, accurately and selectively position the cam for actuation of any individual switch without the unnecessary actuation of associated switches operating from the same cam.

It is a further object of the present invention to provide a sequencing mechanism for selectively actuating and de-actuating at a given time a plurality of switches actuated by a rotary cam rapidly positionable by a motorized drive.

The present invention provides a rotary sequencing mechanism for a plurality of cam operated switches having a rotary cam disc with a plurality of cam tracks on one axial face with each of the function switches having a follower operated by one of the cam tracks for effecting desired program actuation and de-actuation of the switch upon rotary movement of the cam in a forward direction. Upon reverse rotation of the cam by the motorized drive, a second cam track on the cam moves a flip over follower or lift means which effects raising of the contact blade of certain of the switches which are series connected to the appliance function line power.

The switch sequencing assembly of the present invention also includes an auxiliary cam follower operating from a second cam track on the opposite axial face of the cam disc for performing an auxiliary machine function as, for example, operating a dispenser for a fluidized additive.

DETAILED DESCRIPTION

Figure 1:
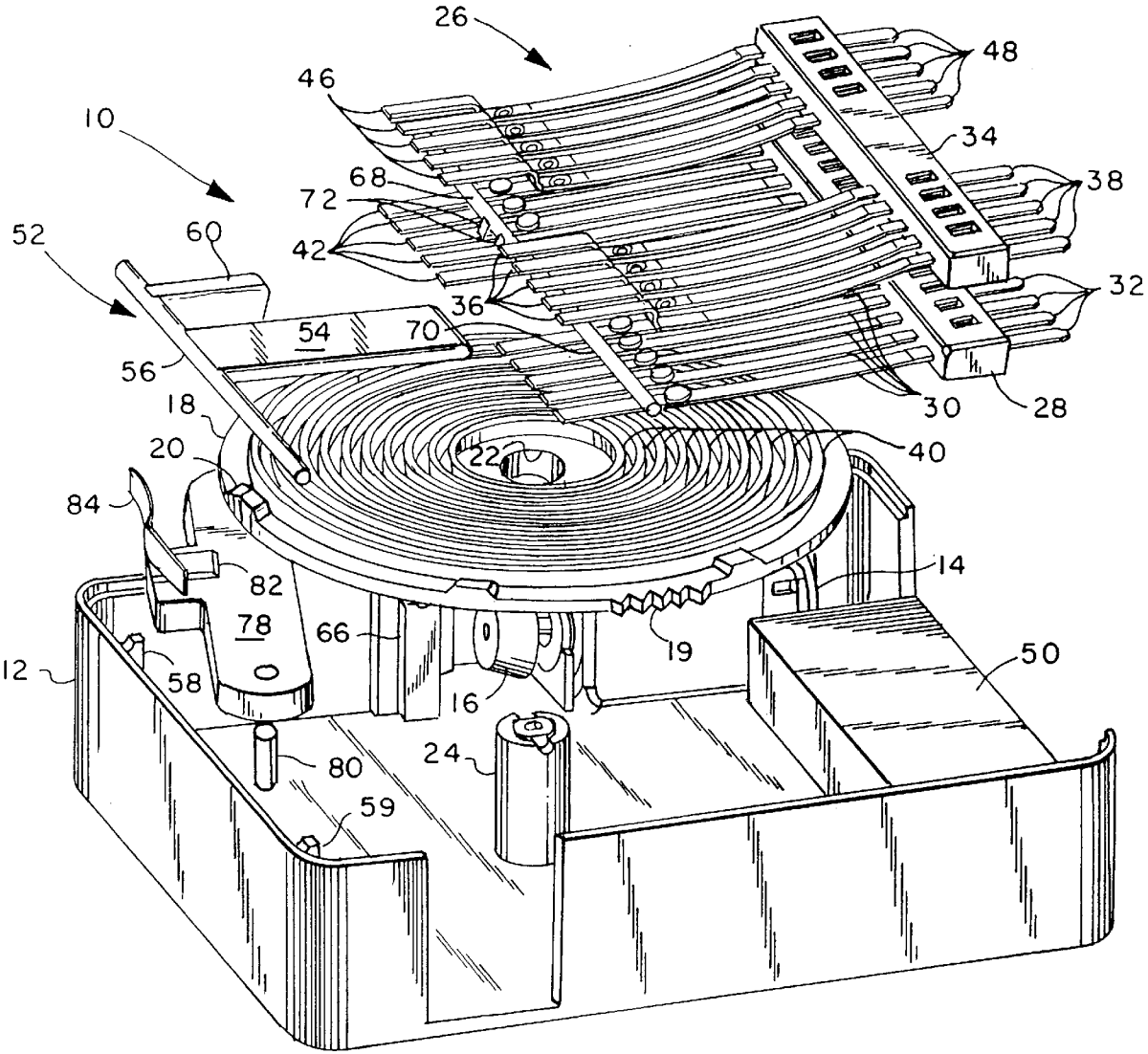
FIG. 1 is an exploded view of the sequencing switch assembly of the present invention.
Figure 2:
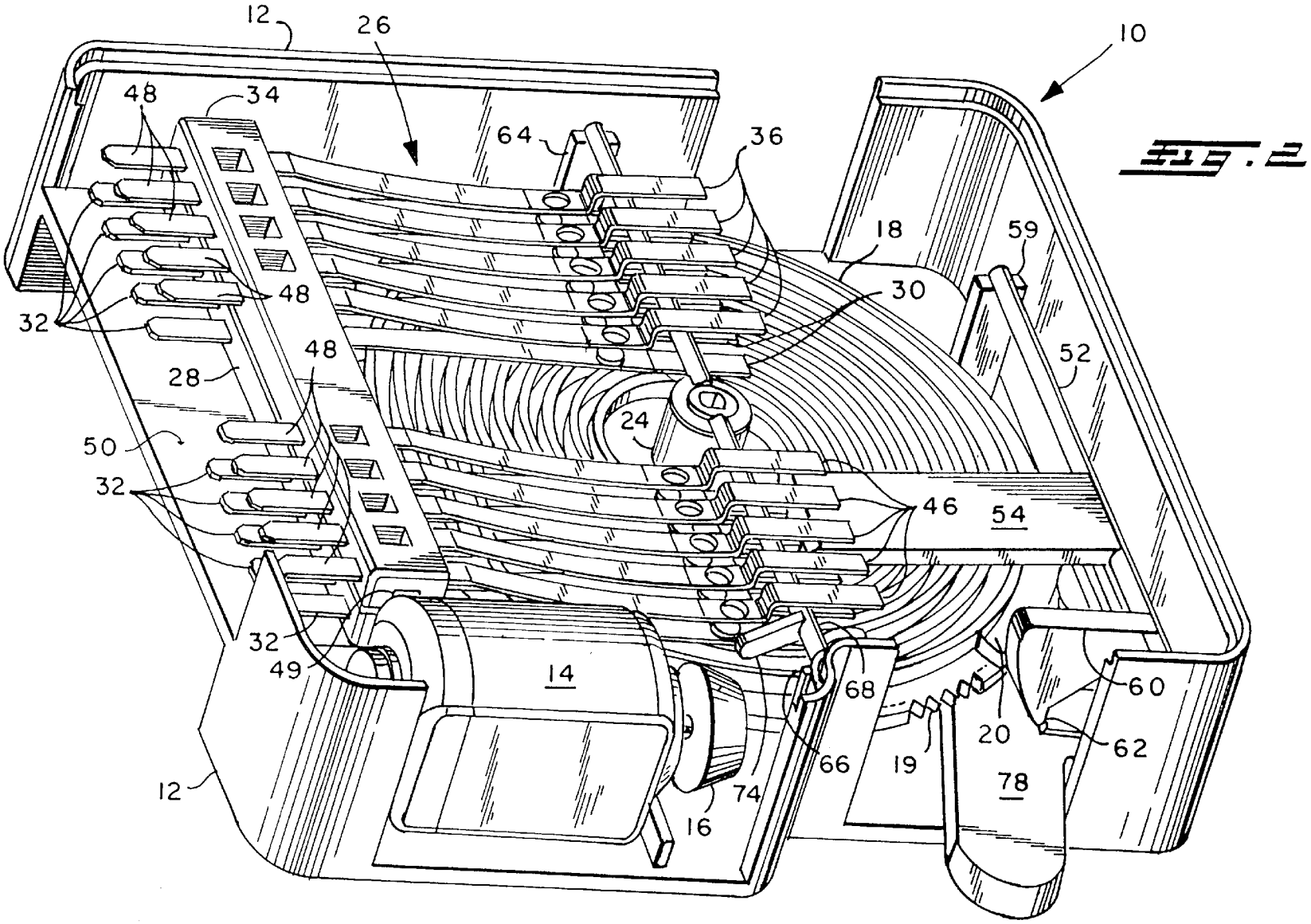
FIG. 2 is an axonometric view from above of the assembled switch of FIG. 1.

Referring to FIGS. 1 and 2, the rotary switch sequencing device of the present invention is indicated generally at 10 and has a housing or casing 12 into which is assembled a drive motor 14 which has an output shaft gear 16, which may be a worm if desired, and which engages in driving relationship a gear track formed on the periphery of the rotary cam disc 18, a portion of which is illustrated and denoted by reference numeral 19 in FIG. 1. If desired motor 14 may be a stepper motor. Disc 18 has a central aperture 22 which is journaled for rotation on a stanchion 24 provided in the casing. Disc 18 has a peripheral cam track 20 formed on the upper axial face thereof.

A plurality of machine or appliance function control switches indicated generally at 26 includes a first or lower mounting block or strip 28 formed of insulating material having a plurality of spaced parallel lower blade contacts 30 mounted thereon with portions of each extending through the block 28 and outwardly therefrom in an opposing direction to form connecting terminals 32. A second or upper mounting block 34 formed of insulating material has a corresponding plurality of spaced upper blade contacts denoted by reference numeral 36 extending therefrom with portions of each contact blade 36 extending through the block 34 and outwardly in an opposite direction to form connecting terminals as denoted by reference numeral 38. Each of the blade contacts 36 has a contact provided thereon which is disposed opposite a corresponding contact mounted on one of the lower blades 30 for opening and closing thereagainst upon movement of either of the upper or lower blades.

The lower blades 30 are suitably configured by any known expedient such as a molded plastic follower on the tip thereof (not shown) to each follow one of a plurality of raised cam tracks denoted by reference numeral 40 provided on the upper axial face of disc 18 and in concentric arrangement. Clockwise or forward rotation of the disc 18 causes the tracks 42 to effect opening and closing individually of each of the lower contact blades 30 with respect to one of the upper blade contacts 36. As shown in FIG. 1, the switch contact blades 30 are each disposed to contact one of the cam tracks 40 on the disc 18.

Lower switch block 28 has a second plurality of spaced generally parallel blade contacts 42 extending therefrom each configured to contact and follow one of the cam tracks 40. Upper switch block 34 has a second plurality of upper contact blades 46 extending therefrom and in spaced parallel arrangement with a contact thereon operative for engaging a corresponding contact provided on one of the lower blade contacts 42. Each of the upper blade contacts 46 has a portion thereof extending through block 34 and outwardly therefrom forming connector terminals as denoted by reference numeral 48. If desired, terminal portions such as denoted by reference numeral 49 may extend from the end of blocks 28, 34 for direct plug-in connection of motor 14 (see FIG. 2).

It will be understood that the switch mounting blocks 28, 34 are disposed in stacked arrangement and mounted by any suitable expedient (not shown) on the raised portion 50 of the casing 12.

A lift member indicated generally at 52 has a paddle portion 54 extending from a pivot shaft 56 with the end of the paddle portion 54 disposed adjacent and underneath the ends of certain ones of upper contact blades 46. The ends of the pivot shaft 56 are journalled on stanchions 58, 59 provided in the casing. Lift member 52 includes a cam or projection 60 extending therefrom and having a lobe 62 formed thereon.

A lever 78 is pivotally mounted on a stanchion 80 provided in casing 12, and has a cam 82 formed thereon. Lever 78 is biased by a spring 84. A portion of lever 78 extends outwardly of casing 12; and, upon movement thereof, for example by a closing latch of an appliance door, lever 78 moves cam 82 to contact lobe 62, raising paddle 54, which in turn lifts certain ones of blades 46 to open line power switches.

A second set of stanchions 64, 66 are provided in casing 12 for supporting the ends of two shafts 68, 70 which are axially coincident and have the adjacent ends thereof supported in grooves provided in the central stanchion 24. Shafts 68, 70 support and locate the ends 46, 36 of the upper contact blades of the switches 26.

Figure 5:
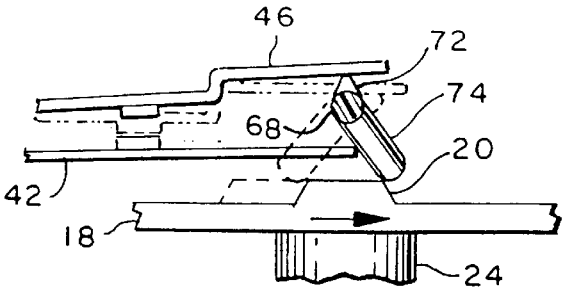

Referring to FIGS. 1 and 5, a flip-over cam follower 74 extends from the shaft 68 and follows the peripheral cam track 20 on disc 18 maintaining the orientation shown in FIG. 2 for clockwise rotation of the disc 18. Shaft 68 has a pair of spaced lobes 72 provided thereon which are disposed immediately below the certain two of the upper contact blades 46 which are in series circuit with the main power line to the appliance to be controlled. During clockwise, or forward, rotation of disc 18, the motion of cam follower 74 is not enough to cause shaft 68 to rotate sufficiently to position lobes 72 to lift blades 46 and thus, the lobes 72 are idle during such clockwise rotation.

Referring to FIG. 5, the disc 18 is shown as having been moved in a counterclockwise direction or in the direction of the arrow from the position shown in FIG. 2 to the position shown in FIG. 5 in solid outline to cause cam 20 to move flip-over follower 74 from the position shown in dashed outline, which corresponds to the position shown in FIG. 2, to the position shown in solid outline in FIG. 5. Shaft 68 is thereby rotated approximately one-quarter turn in the counterclockwise direction to raise the lobes 72 from the position shown in dashed outline to the position shown in solid outline in FIG. 5 thereby raising contact blade 46 to break contact with the lower contact blade 42. Thus, reverse rotation of the cam disc 18 is operative by means of the track 20, cam follower 74, shaft 38 and lobe 72 to break line power to the appliance thereby preventing the opening and closing of any of the remaining switches 46 during reverse rotation of cam disc 18 from electrically operating any machine function during such reverse rotation.

Figure 3:
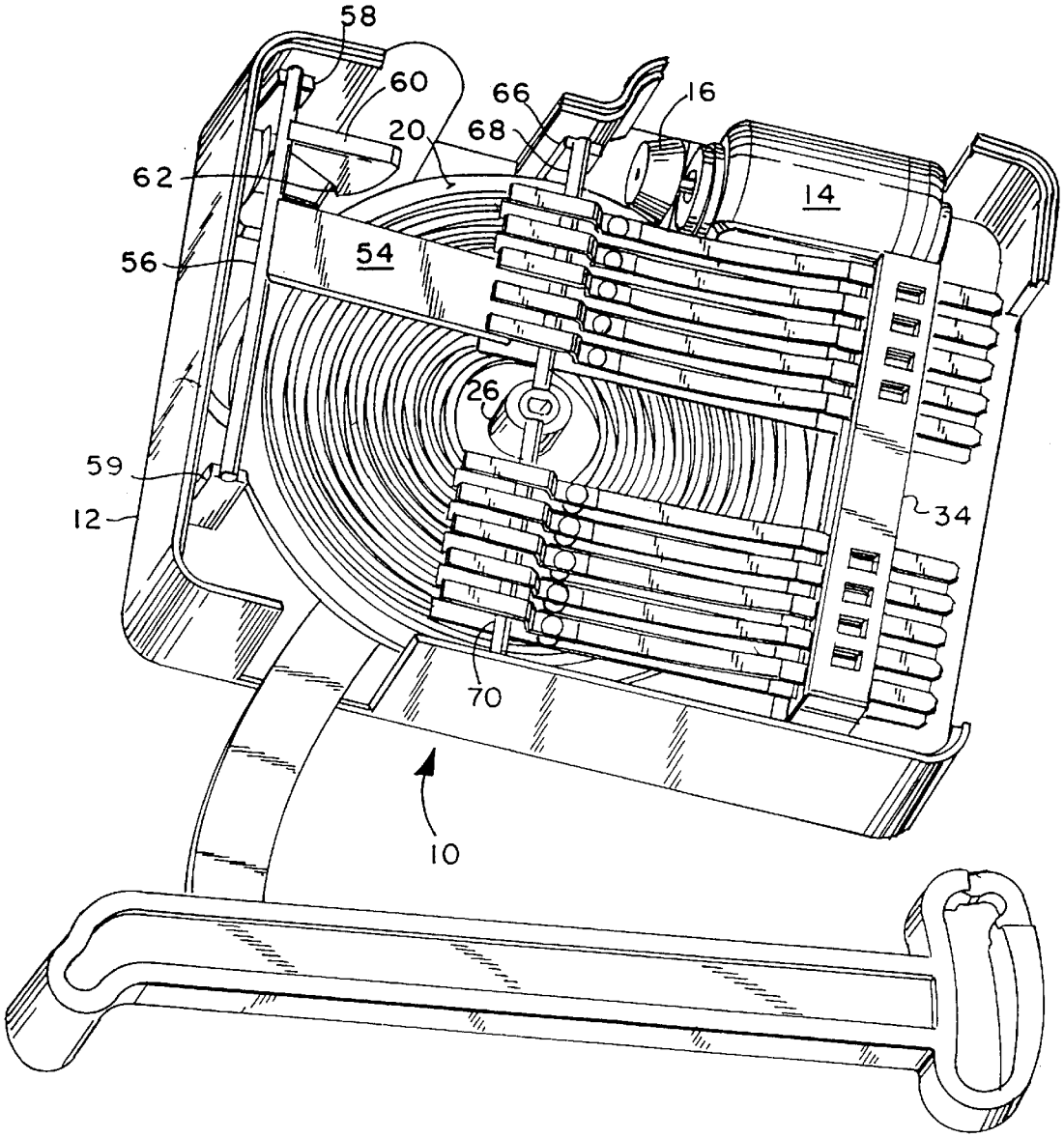
FIG. 3 is a view similar to FIG. 2 from the back side showing the auxiliary cam follower embodiment.
Figure 4:
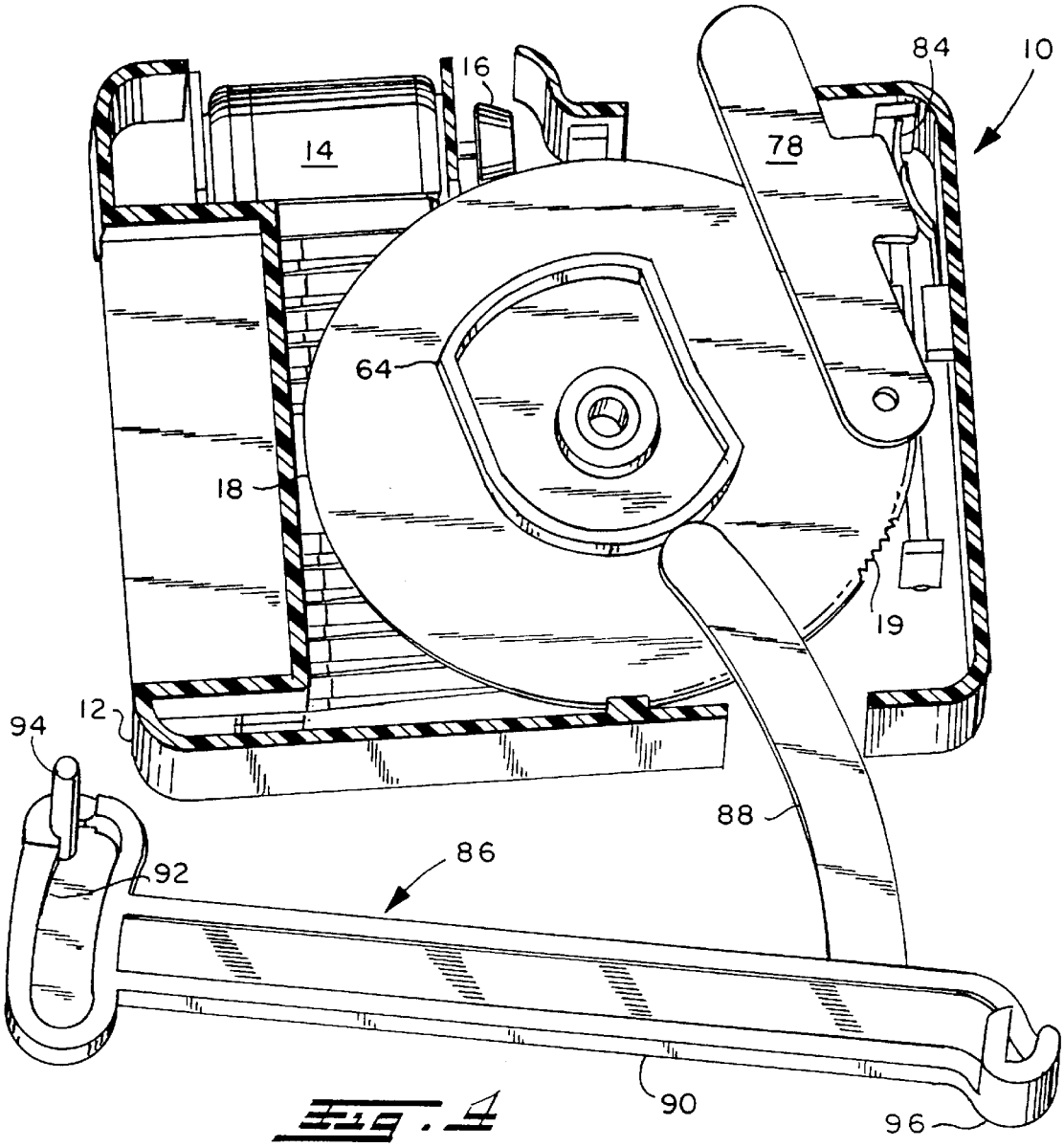
FIG. 4 is an axonometric view from the underside of the embodiment of FIG. 3 and, FIG. 5 is an enlarged portion of a front elevation of FIG. 1.

Referring to FIGS. 3 and 4, an auxiliary cam follower 86 has an arm 88 which contacts the secondary or radial cam 64 provided on disc 18 on the side of disc 18 opposite tracks 40. Arm 88 is connected to a lever 90 which is pivoted at one end by a slot 92 formed therein which has portions thereof registered against a stanchion or pin 94 provided on the appliance or machine structure. The opposite end 96 of lever 90 may be used to perform an auxiliary appliance or machine function such as, for example, operation of a fluid dispenser. In a dishwasher appliance, casing 12 can be mounted on the inside of the dishwasher door and the cam follower 86 utilized to operate a liquid dispenser such as used for a rinsing aid.

The present invention thus provides a simple, reliable and relatively low cost sequencing switch assembly having a reversible motor drive, such as a stepper motor, which under electronic control can rapidly position a cam disc for selectively actuating program function control switches, including power line switches. During reverse rotation of the cam disc, a flip-over cam follower lifts the blade contacts of the line power switch for electrically disabling the program switches during reverse cam rotation.

Although the present invention has been described hereinabove with respect to the illustrated embodiments, it will be understood that the invention is capable of modification and variation and is limited only by the scope of the following claims.

We claim:

1. A sequencing switch assembly comprising:

(a) housing structure including motor means mounted thereon;

(b) a cam rotatably mounted on said housing means, said cam having a plurality of first cam tracks thereon and at least one second cam track thereon;

(c) drive means operatively connected to said motor means for effecting rotary movement of said cam in a forward direction and a reverse direction;

(d) a plurality of switches each including cam follower means and disposed for actuation by contacting one of said plurality of first cam tracks upon rotation of said cam in said forward direction; and, (e) lift means operative upon rotation of said cam in said reverse direction, for lifting certain ones of said switches from contacting said cam tracks.

2. The switch assembly defined in claim 1, wherein said auxiliary follower means contacting said second cam track, including a member extending externally of said housing structure, and responsive to movement of said cam in said forward direction for effecting an auxiliary function.

3. The switch assembly defined in claim 1, wherein said cam has a generally disc shaped configuration and said plurality of first cam tracks is disposed on one face of said disc and said second cam track is disposed on a face of said disc opposite said one face.

4. The switch assembly defined in claim 1, wherein said cam has a generally disc shaped configuration and said plurality of first cam tracks are disposed in concentric arrangement on one axial face of said cam.

5. The switch assembly defined in claim 1, wherein said lift means includes means following said second cam track.

6. The switch assembly defined in claim 1, further comprising an auxiliary cam track and follower means responsive to said auxiliary cam track for performing an auxiliary function.

7. The switch assembly defined in claim 1, wherein said lift means includes a cam follower following said second cam track and a member pivoted on said housing structure.

8. The switch assembly defined in claim 1, further comprising an auxiliary cam track and auxiliary follower means moveably responsive to follow said auxiliary cam track; and, dispenser means operative in response to movement of said auxiliary follower means to dispense a fluidized additive selected from the group consisting of (a) granular and (b) liquid.

9. The switch assembly defined in claim 8, wherein said additive includes a rinsing aid.

10. The switch assembly defined in claim 1, wherein said at least one of said plurality of first switches and said at least another of said plurality of first switches are disposed on opposite sides of the center of said disc.

11. The switch assembly defined in claim 1, wherein one of said plurality of switches comprises a line switch and has contact block portions thereof extending outwardly therefrom, and, said motor means has terminal means engaging and outwardly extending blade contact portions in direct plug-in arrangement.

12. A switch sequencing assembly comprising:

(a) housing structure;

(b) a cam mounted for rotary movement on said housing structure;

(c) motorized drive means disposed on said housing structure and operable in response to an electrical control signal to effect said rotary movement selectively in a forward and reverse direction;

(d) a plurality of function control switches disposed on said housing structure;

(e) cam follower means operative in response to said forward rotary movement of said cam for actuating and de-actuating said switches individually in sequence; and, (f) lift means operative in response to said reverse rotary movement to disable certain ones of switch means.

13. The switch assembly defined in claim 12, wherein said cam includes a first cam track contacted by said cam follower means; and said cam includes a second cam track and said lift means includes secondary cam follower means contacting said second cam track.

14. The switch assembly defined in claim 12, wherein said cam comprises a disc having a first and second track on one axial face thereof with said cam follow means contacting said first track said lift means contacting said second track.

* * * * *